United States Patent [19]

Leidich

[11] 4,282,478

[45] Aug. 4, 1981

[54] REFERENCE CURRENT SUPPLY CIRCUITS

[75] Inventor: Arthur J. Leidich, Flemington, N.J.

[73] Assignee: RCA Corporation, New York, N.Y.

[21] Appl. No.: 101,848

[22] Filed: Dec. 10, 1979

Related U.S. Application Data

[63] Continuation-in-part of Ser. No. 948,104, Oct. 3, 1978, abandoned.

[51] Int. Cl.[3] ..... G05F 1/56

[52] U.S. Cl. ..... 323/316; 323/312

[58] Field of Search ..... 323/1, 4, 9

[56] References Cited

U.S. PATENT DOCUMENTS

| | | | |
|---|---|---|---|
| 3,246,233 | 4/1966 | Herz | 323/4 |
| 3,588,672 | 6/1971 | Wilson | 323/4 |
| 3,761,801 | 9/1973 | Sheng | 323/4 X |
| 3,903,454 | 9/1975 | Matsui et al. | 323/4 X |
| 3,906,332 | 9/1975 | Keller | 323/4 |

FOREIGN PATENT DOCUMENTS

| | | | |
|---|---|---|---|
| 2532397 | 2/1977 | Fed. Rep. of Germany | 323/4 |
| 561177 | 8/1977 | U.S.S.R. | 323/4 |

*Primary Examiner*—William H. Beha, Jr.
*Attorney, Agent, or Firm*—E. M. Whitacre; P. J. Rasmussen; Allan J. Jacobson

[57] ABSTRACT

A current flows between the collector and emitter electrodes of a transistor responsive to an operating potential being impressed between them, the emitter-base junction of the transistor being forward biased by leakage current flowing across its own collector-base junction. Increase of the current flow between the collector and emitter electrodes of the transistor beyond a desired level is precluded by sensing the current flow, applying the sensed current to a current-to-voltage converter, and applying the resultant voltage to the input of a threshold detector. The output circuit of the threshold detector shunts current away from the emitter-base junction of the transistor when the current flow between its collector and emitter electrodes tends to exceed its desired level thereby to cause the voltage applied to the input circuit of the threshold detector to exceed a predetermined threshold value.

9 Claims, 3 Drawing Figures

REFERENCE CURRENT SUPPLY CIRCUITS

This is a continuation-in-part of application Ser. No. 948,104, filed Oct. 3, 1978, now abandoned.

The present invention relates to reference current supplies and in particular to such supplies as supply reference currents related to the flow of current between the collector and emitter electrodes of junction transistors operated without application of base currents other than those derived from the leakage currents across their collector-base junctions.

A problem with such configurations is that the relatively low breakdown voltage characteristics of a transistor operated with open-circuit base connection can cause the flow of current between its collector and emitter electrodes to increase to much higher value than designed for. Also, under higher operating temperatures increase in the leakage current across the collector-base junction of the transistor can result in thermal runaway conditions where the current flow between the collector and emitter of the transistor undesirably rises by orders of magnitude.

The present invention improves any of such reference current supplies by shunting a portion of the leakage current across the collector-base junction of the transistor away from it to reduce the base current flow to its emitter-base junction, whenever the reference current undesirably tends to exceed its prescribed value.

Figure 1:
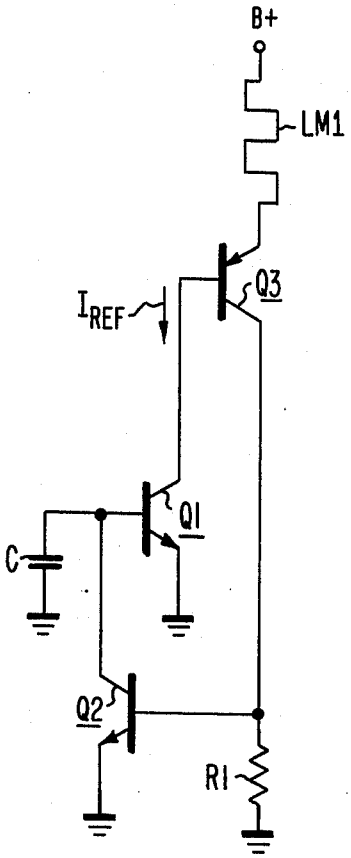
FIGS. 1 and 2 are schematic diagrams of representative reference current supplies of the abovedescribed type, each embodying the present invention.

Referring to FIG. 1 an NPN transistor Q1 has an operating potential applied between its emitter electrode, which is grounded, and its collector electrode, which is connected to the base electrode of a PNP transistor Q2 and thence to a positive potential B= through the emitter-base junction of Q2 and a conductive path provided by a load means LM1. This conditions Q1 for exhibiting leakage current flow across its collector-base junction, which leakage current tends to flow as forward-biasing base current to the emitter-base junction of Q1. Without further forward bias current applied to its emitter-base junction a typical small geometry vertical structure transistor used by RCA Corporation in its junction-isolated monolithic integrated circuits (e.g. the CA3045) will under open-circuit base conditions typically conduct a collector-to-emitter reference current $I_{REF}$ of 8 picoamperes responsive to a 10 volt emitter-to-collector voltage. This reference current $I_{REF}$ applied as base current to a lateral structure transistor Q3, having a typical common-emitter forward current gain ($h_{fe}$) of ten at such levels of base current, will demand an emitter current ($h_{fe}+1$) times as large—i.e., 88 picoamperes—and supply a collector current $h_{fe}$ times as large—i.e., 80 picoamperes. In FIG. 1 the emitter current of Q3 is withdrawn via load means LM1.

The tendency of this current to exceed a desired level responsive to $I_{REF}$ exceeding a prescribed value is checked as follows. The levels of the reference current and of the current drawn through load means LM1 are sensed indirectly, by applying the collector current of Q3 to a linear resistance R1. Q3 and R1 function then as a current-to-voltage coverting means providing a voltage drop across R1 proportional to $I_{REF}$, relying upon the 1:$h_{fe}$ ratio relationship between the base and collector electrodes of Q3 and upon the Ohm's Law relationship between the current through R1 and the potential drop across R1. The output potential from this current-to-voltage converting means is applied to the input circuit of a threshold detector means essentially consisting of in FIG. 1 an NPN transistor Q2.

This proportionality is adjusted—e.g. by proper selection of the resistance value of R1—so that the output potential of this current-to-voltage coverting means will reach a particular value when $I_{REF}$ tends to exceed its prescribed value. This particular value of output potential is incrementally larger than the threshold value of potential required to make the output circuit of the threshold detector, essentially consisting of Q2 in FIG. 1, conductive to shunt a portion of the leakage current flowing across the collector-base junction of Q1 from flowing as forward-biasing base current to the emitter-base junction of Q1. This completes a non-linear feedback loop for constraining the value of $I_{REF}$ to its prescribed value.

A small capacitor C, a few picofarads or less, may be included as shown to ensure unconditional stability of the feedback loop against any tendency towards high frequency regeneration.

Figure 2:
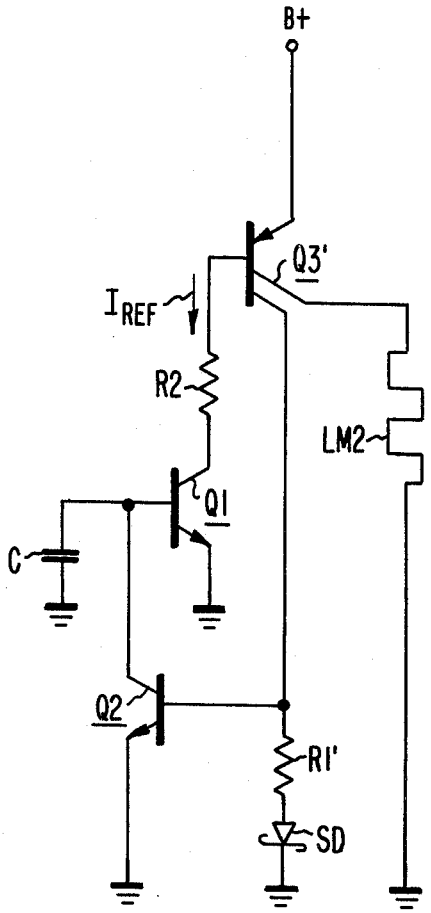

In FIG. 2 the emitter-loaded, single-collector PNP transistor Q3 is replaced by dual-collector PNP transistor Q3'. The emitter electrode of Q3' is connected directly to B+ without intervening load means, and the one of the collector electrodes of Q3' not connected to the base electrode of Q2 is connected to supply, to a load means LM2 having a direct current conductive path therethrough to ground, a current proportionally related to $I_{REF}$. A resistance R2 is inserted between the collector electrode of Q1 and the base electrode of Q3' to limit current during initial application of B+ potential before the threshold detector, here including Schottky-barrier diode SD as well as Q2, would have a chance to assert its shunt regulation of base current to Q1.

Insertion of Schottky diode SD in series with R1' reduces the level of current which has to flow therethrough in order to develop a potential drop thereacross sufficient to bias Q2 into conduction. This inasmuch as the 0.25 volt or so forward offset potential across the Schottky-barrier diode SD comprises a substantial portion of the 0.55 volt or so potential required across the emitter-base junction of Q2 to render it conductive. Application of direct bias currents to R1 or R1' is another way to reduce the apparent threshold voltage required to render conductive the output circuit of the threshold detector means—i.e. the collector-to-emitter circuit of Q2 in the illustrated embodiments. Or one may bias the emitter electrode of Q2 slightly negative with respect to ground.

Increased levels of reference current output through load means LM1 (or LM2) may be provided by providing increased values of $h_{fe}$ transitor Q3 (or Q3'). Alternatively, one or more stages of current amplification may be provided to boost the reference current output to any desired level.

Figure 3:
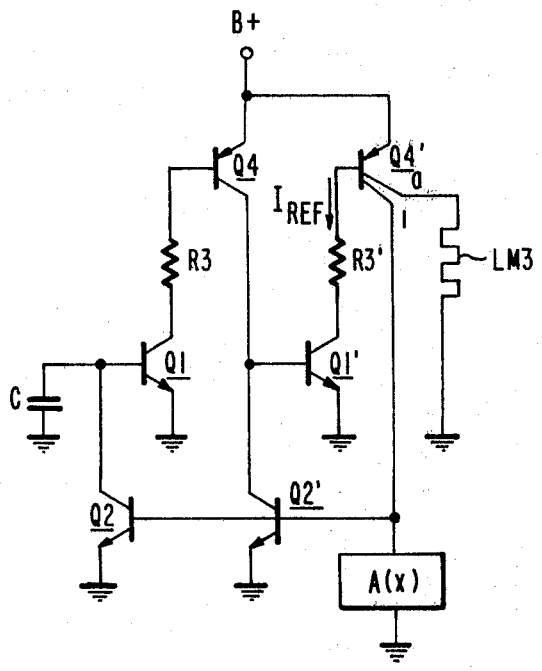
FIG. 3 shows a two-stage cascaded reference current supply embodying the present invention.

FIG. 3 shows a two-stage cascaded circuit for making available a widened range of reference current levels responsive to adjustment of a current-to-voltage converter means A(x), which might, for example, simply be a linear resistance element. The first stage of regulation comprises transistors Q1 and Q4; the second stage comprises transistors Q1′ and Q4′, which latter transistor has an additional collector region for current output to load means LM3.

Collector-emitter leakage current through Q1 is amplified by the $h_{fe}$ of Q4 and a portion thereof supplied as base current to Q1′. The collector current of Q1′ is in turn supplied as base current to Q4′. Multiple collectors of Q4 are in fixed ratio 1:a according to their respective junction areas so that base current of Q4 is amplified and supplied to current-to-voltage converter means A(x) and to the load means LM3 in the same fixed ratio 1:a. The feedback mechanism is via a current-to-voltage converting means A(x) and threshold detection means Q2, Q2′. Note that each stage has a separate threshold detector means, but both stages share a single current-to-voltage converter means.

Any tendency of the output current in LM3 to exceed a prescribed value will also cause an increasing voltage across A(x) so as to render Q2 and Q2′ more conductive. Such action shunts a portion of the respective base currents of Q1 and Q1′ to ground via Q2 and Q2′. Shunting base current away from Q1 and Q1′ reduces the respective collector currents supplied as base currents to Q4 and Q4′, which tends to reduce the current to A(x). Resistors R3 and R5 are included to limit initial current transients upon turn on.

An important aspect of the cascaded circuit in FIG. 3 is the range of regulated output currents available as a function of A(x). At the high end of the range, current through LM3 is less than or equal to $I_{CEO\text{-}Q1}\cdot\beta_{Q4}\cdot\beta_{Q\text{-}1'}\cdot\beta_{Q4'}\cdot a/(1+a)$. However at the low end, current through LM3 is greater than or equal to $I_{CBO\text{-}Q1'}\cdot\beta_{Q\text{-}4'}\cdot a/(1+a)$. Thus, the maximum current ouput available is greatly increased over that available from a single stage circuit, while the minimum current is the same as that for a single stage circuit. The circuit conditions at the extremes of output currents can be readily visualized from viewing FIG. 3.

It can be seen that a greater value for ouput current may be achieved by reducing the output voltage-to-input current ratio provided by A(x). When A(x) is adjusted to very low voltage output, Q2 and Q2′ are essentially non-conductive. All the leakage current, $I_{CEO}$, through Q1 is the base current of Q4. Since Q2 is also presumed non-conductive, all of the collector current of Q4 is available as base current to Q1′. Output current level to LM3 is therefore boosted by the gain of the second stage proportional to the product of the respective current gains of Q1′ and Q4′.

When A(x) is adjusted to a very high voltage output, Q2 and Q2′ are fully conductive, essentially shorting the base-emitter junctions of Q1 and Q1′ to ground. Collector leakage current in Q1 is then $I_{CBO\text{-}Q1'}$ which current is multiplied by the beta of Q4. However, the collector current output of Q4 is shunted to ground via Q2′ which effectively cuts off the gain of the first cascaded stage from increasing the output to the load means LM3. The output current is no longer determined by Q1, but only by Q1′. The collector current of Q1′, $I_{CBO\text{-}Q1'}$, is multiplied by current gain of Q4′ to supply the output load means LM3.

More than two stages of reference current supplies may be cascaded to increase the maximum current available. The minimum current available, however, does not increase beyond that available from a single stage circuit because the last stage of any string of cascaded circuits cuts off the gain of all the preceding circuits.

One skilled in the art of electronic circuit design and armed with the foregoing disclosure will be enabled to design many different current supplies within the scope and spirit of the invention, and the following claims should be accordingly liberally construed to include such current supplies within the ambit of their terms. E.g., one may operate circuits similar to that shown in FIG. 1 (or 2) so that Q2 provides continuous shunt regulation of base current to Q1 introducing additional current gain of predetermined value between the PNP transistor Q3 (or Q3′) and the base of Q2, this being done to permit small currents to be delivered to the load means LM1 (or LM2) without requiring so small values of resistance of R1 (or R1′).

What is claimed is:

1. In a current supply having a first transistor of a first conductivity type, having emitter-base and collector-base junctions and having emitter and collector and base electrodes;

means for applying an operating potential between the emitter and collector electrodes of said first transistor to cause leakage current across its collector-base junction;

means arranging the emitter-base junction of said first transistor to be forward-biased by base current quintessentially derived solely from said leakage current, for conditioning said first transistor to conduct a reference current between its collector and emitter electrodes; and means for applying said reference current to utilization means an improvement for preventing said reference current for undesirably exceeding a prescribed value comprising:

threshold detector means having an input circuit; and having an output circuit connected for shunting a portion of said leakage current away from the emitter-base junction of said first transistor responsive to its input circuit having applied thereto an input voltage exceeding a prescribed threshold value; and current-to-voltage converter means having an input circuit connected to receive said reference current, having an output circuit connected to the input circuit of said threshold detector means for supplying input voltage thereto, and providing a current-to-voltage conversion between its input and output circuits such that said threshold value of input voltage to said threshold detector means is reached at said prescribed value of reference current.

2. An improved current supply according to claim 1 wherein said threshold detector means comprises:

a second transistor being of said first conductivity type, having emitter and base electrodes with an emitter-base junction therebetween included in the input circuit of said threshold detector means, and having a collector electrode connected to the base electrode of said first transistor for completing the output circuit of said threshold detector means.

3. An improved current supply as set forth in claim 2 wherein said current-to-voltage converter means comprises:

a third transistor being of a second conductivity type complementary to said first conductivity type, having emitter and base electrodes with an emitter-base junction therebetween arranged for sensing the collector current of said first transistor, and having a collector electrode connected to the base electrode of said second transistor; and linear resistance means in connection between the base and emitter electrodes of said second transistor.

4. An improved current supply as set forth in claim 3 wherein said threshold detector means includes an offset diode inserted in series with said linear resistance means in its connection between the base and emitter electrodes of said second transistor.

5. An improved current supply means as set forth in claim 3 wherein said connection between the base and emitter electrodes of said second transistor essentially consists of said linear resistance means.

6. A current supply comprising:

a plurality of cascaded current supply stages, each stage comprising a respective first transistor of a first conductivity type, each respective first transistor having emitter-base and collector-base junctions, and having emitter, collector, and base electrodes, each of said plurality of current supply stages including means for applying an operating potential between the emitter and collector electrodes of its respective first transistors to cause leakage current across its respective collector-base junction, each stage further comprising respective current amplifier means responsive to current across the collector-base junction of its first transistor for supplying at least one respective current output for that stage;

means for forward biasing the emitter-base junction of the first transistor of the first of said plurality of current supply stages with base current quintessentially derived solely from said leakage current across its collector-base junction, and means for connecting said plurality of current supply stages in cascade wherein the respective current output of the current amplifier means of each stage, except the last, is connected to the respective base electrode of the first transistor in each succeeding stage;

a plurality of the threshold detectors, equal in number to said plurality of current supply stages, each of said plurality of threshold detectors having an input circuit and an output circuit, each respective output circuit connected to a corresponding current supply stage for shunting a portion of the respective base current away from the emitter-base junction of the respective first transistor of said corresponding current stage responsive to the input circuit of said corresponding threshold detector having applied thereto an input voltage exceeding a prescribed threshold value; and current-to-voltage converter means having an input circuit connected to receive an output current from the current amplifier means of the last of said pluraltiy of current supply stages, having an output circuit connected to each of the input circuits of said plurality of threshold detector means for supplying input voltage thereto, and providing a current-to-voltage conversion between its input and output circuits such that said threshold value of input voltage to said plurality of threshold detectors is reached at a prescribed value of the output current, supplied from the current amplifier means of the last current supply stage, to the input of said current-to-voltage converter means.

7. A current supply according to claim 6 wherein said current-to-voltage converter means has an adjustable range of current-to-voltage conversion ratios for producing a range of values for said reference current between prescribed high and low reference current levels, wherein at said prescribed high reference current level, said current-to-voltage converter means conditions each of said plurality of threshold detectors for substantially non-conduction at its respective output terminal so that said prescribed high reference current level is no larger than said reverse-biased collector-to-emitter current of said first transistor of said first current supply stage times the product of the current gains of the remaining cascaded current supply stages, and wherein at said prescribed low reference current level, said current-to-voltage converter means conditions each of said plurality of threshold detectors for substantially full conduction at its respective output terminal so that said prescribed low reference current level is no smaller than said reverse-biased collector-to-base leakage current of said first transistor of said last current supply stage times the current gain of said last current supply stage.

8. A current supply means according to claim 7 wherein each of said respective threshold detector means comprises:

a respective second transistor being of said first conductivity type, having respective emitter and base electrodes with an amitter-base junction therebetween included in the respective input circuit of said respective threshold detector means, and having a respective collector electrode connected to the respective base electrode of said first transistor of said corresponding current supply stage for completing the output circuit of said respective threshold detector means.

9. A current supply according to claim 8 wherein each of said respective current amplifier means comprises:

a respective third transistor being of a second conductivity type complementary to said first conductivity type, having respective emitter and base electrodes with a respective emitter-base junction therebetween arranged for sensing the collector current of respective first transistor of said respective current supply stage, and having a respective collector electrode connected for supplying said respective current output from each of said respective current supply stages.

* * * * *